US005934450A

United States Patent [19]

Rynk et al.

[11] Patent Number: 5,934,450

[45] Date of Patent: Aug. 10, 1999

[54] ELECTRONIC DEVICE WITH HOLOGRAPHIC KEYPAD

[75] Inventors: Evan Francis Rynk, Boca Raton; Michael John Harshbarger, Sunrise, both of Fla.

[73] Assignee: Motorola, Inc., Schaumburg, Ill.

[21] Appl. No.: 09/110,282

[22] Filed: Jul. 6, 1998

[51] Int. Cl.[6] ..... H01H 9/18

[52] U.S. Cl. ..... 200/308

[58] Field of Search ..... 200/308, 309, 200/311, 317; 359/15; 264/1.34; 396/2.88

[56] References Cited

U.S. PATENT DOCUMENTS

| | | | |
|---|---|---|---|
| 4,375,585 | 3/1983 | Lee | 200/308 X |
| 4,758,701 | 7/1988 | Nagel | 200/314 X |
| 5,455,129 | 10/1995 | Bussard | 359/2 X |
| 5,557,079 | 9/1996 | Jackson et al. | 205/5 |
| 5,573,107 | 11/1996 | Makano et al. | 200/311 X |
| 5,599,594 | 2/1997 | Pauley | 428/13 |

*Primary Examiner*—Renee S. Luebke
*Attorney, Agent, or Firm*—Andrew S. Fuller

[57] ABSTRACT

An electronic device (100) has a keypad (150) that is backed by holographic film material (155) to enhance keypad lighting and overall appearance. Images (252) are formed on the holographic film (155) to indicate button functionality, and switch actuator buttons (160) are embossed over the images. The switch actuator buttons (160) are preferably aligned with switches (260) such that depression of a button (160) actuates a corresponding switch (260).

10 Claims, 3 Drawing Sheets

200

ELECTRONIC DEVICE WITH HOLOGRAPHIC KEYPAD

TECHNICAL FIELD

This invention relates in general to user input devices, and more particularly, to keypad or button based input devices.

BACKGROUND OF THE INVENTION

Many electronic devices have keypads that are used to provide input for overall operational control. A keypad is typically organized as a cluster of buttons arranged in a pattern, and indicia located on or near the buttons to identify function. Oftentimes, the keypad is designed for functionality, with respect to the shape and layout of the buttons. The keypad may have other features, such as backlighting for operation in low ambient light, or other lighting to aid in operation.

The design of a keypad may also be influenced by aesthetic considerations. For example, a stylistically designed keypad can serve as a distinguishing feature for the electronic device. In a market-driven environment, such considerations can contribute significantly to a winning design.

Holographic images have been embossed on a variety of devices for aesthetics and functional purposes. For example, it is known to use holographic images to thwart attempts at fraudulently copying a particular item, such as a credit card, drivers license, and the like. It is also known to use such images for entertainment purposes.

It is desirable to provide improvements in keypad designs for electronic devices. Therefore, a new approach to keypad design is needed to provide improvements in aesthetics and functionality.

DETAILED DESCRIPTION OF THE PREFERRED EMBODIMENT

Figure 1:
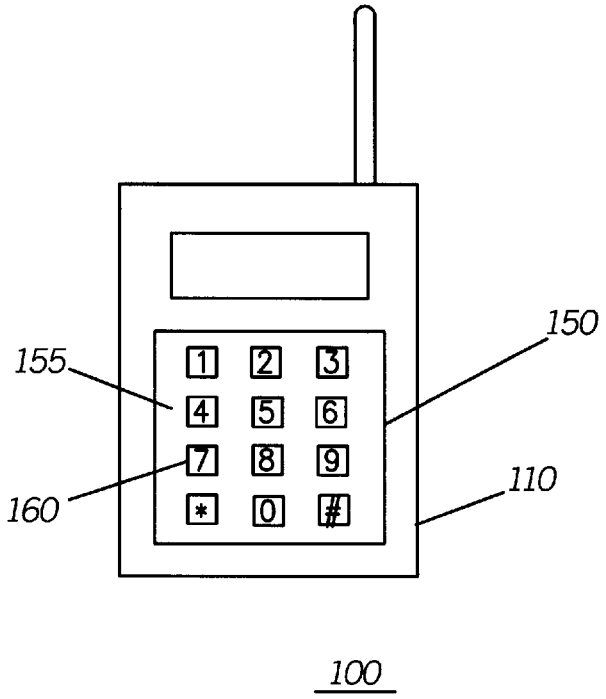
FIG. 1 is a front view of a portable radio communication device incorporating a holographic keypad, in accordance with the present invention.

While the specification concludes with claims defining the features of the invention that are regarded as novel, it is believed that the invention will be better understood from a consideration of the following description in conjunction with the drawing figures, in which like reference numerals are carried forward.

Generally, the present invention provides for an electronic device having a holographic keypad. Preferably, holographic film material provides backing for a set of light transmissive keypad buttons, and is disposed between the buttons and keypad switches. In one embodiment, the holographic film has images thereon that identify functionality, and transparent material is embossed over the images to form buttons. The buttons actuate corresponding switches when depressed. In another embodiment, the holographic film, with or without an image, functions as a background or reflector for a set of keypad buttons, and provides an aesthetically distinctive appearance.

Referring now to FIG. 1, a front view of electronic device 100 is shown, in accordance with the present invention. The electronic device 100 is a portable radio telephone that supports two-way communication over a radio frequency (RF) link, in a manner well-known in the art. A radio housing 110, typically formed from plastic or other similar material, encloses or carries electrical circuitry for the radio 100. The radio 100 includes a holographic keypad 150 which provides an interface to enable control access to the internal functions of the radio. The keypad interface 150 includes switch actuator buttons, or key buttons 160, that enable radio functions. The holographic keypad 150 includes a holographic film 155 disposed below the buttons 160, and providing a backing therefor in the form of a reflector. In one embodiment, the holographic film covers a substantial portion of the keypad interface 150, while in a second embodiment, the holographic film is in register with the buttons, and is formed to be positioned below the buttons.

Figure 3:
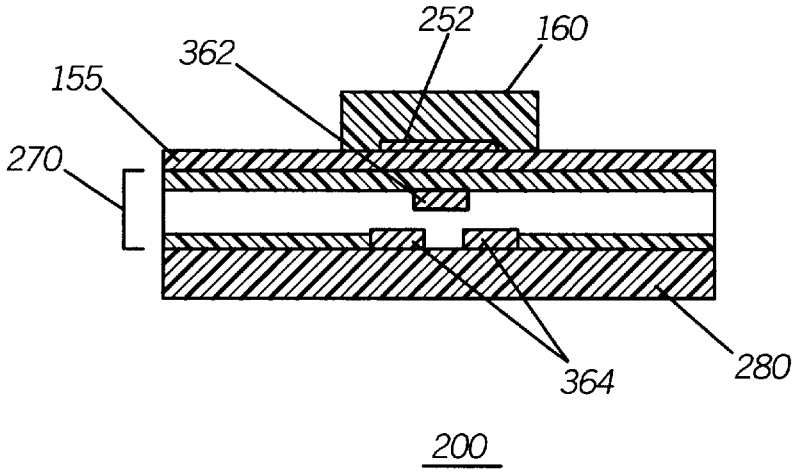
FIG. 3 is a cross-sectional view of a portion of the holographic keypad of FIG. 2.
Figure 2:
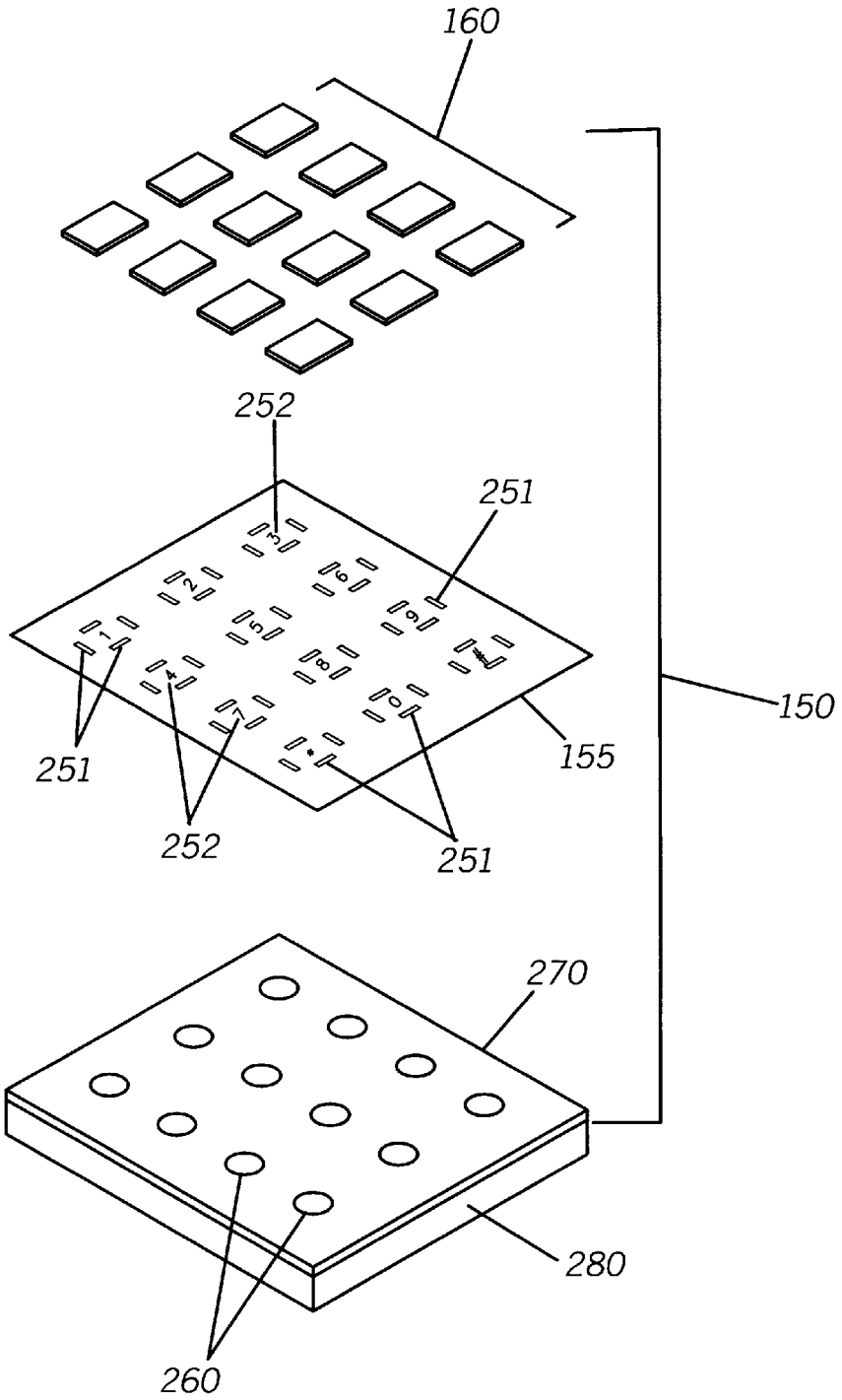
FIG. 2 is an exploded view of a first embodiment of the holographic keypad, in accordance with the present invention.

FIG. 2 is an exploded view of a keypad interface 200, in accordance with the present invention. FIG. 3 is a fragmentary cross-sectional view of the keypad interface 200. Referring to FIGS. 2 and 3, the keypad interface 200 includes the key buttons 160 and the holographic film 155 of the keypad 150, and a circuit carrying substrate 280 to which the keypad is interfaced. The keypad 150 includes an array of light transmissive or transparent key buttons 160, formed from clear plastic, silicone, or the like. The key buttons 160 are preferably embossed over the holographic film 155, such as by injection molding and the like.

The holographic film 155 comprises a photopolymer film which operates on the principles of optical diffraction to manipulate light. Preferably, the photopolymer film is exposed to a holographic laser recording process to define three-dimensional light distribution images. This type of holographic film is commercially available. In the preferred embodiment, the film 155 functions as a backer for the keypad, and has button indicia 252 formed thereon to provide an indication of button functionality when viewed through the transparent key buttons. Particularly, the button indicia 252 comprises images depicting key button functionality, which are formed on the holographic film at locations corresponding to the location of the buttons. The film 155 also has cut out portions 251, corresponding to the individual keys 160, such that the holographic film has the flexibility to sustain up/down motion to support the motion of individual keys.

The keypad 150 further comprises a resilient insulative material 270 that is disposed adjacent to the circuit carrying substrate 280, which is a printed circuit board in the preferred embodiment. The key buttons 160 actuate switches 260, having portions 364 formed on the printed circuit board 280, and portions 362 formed on the membrane material 270. Each switch 260 includes an interrupted signal line 364 that forms a pair of switch ports. The switch ports 364 are electrically coupled to other circuitry of the radio to enable specific radio features. Each switch 260 also includes a conductive pad 362 that operates as a switch contact for closing the switch, i.e., for bridging the interrupted signal lines or pair of switch ports 364 on the printed circuit board 280. The switch contact 362 is situated on the keypad 150 and is maintained in a spaced-apart relationship from the switch ports 364 of the printed circuit board 280 when the switch is not actuated.

When the keypad is fully assembled, the buttons 160 are aligned, or are otherwise associated with the images formed on the holographic film that indicate button functionality. Additionally, each button 160 is aligned so as to be in register with a corresponding switch 260. Accordingly, depression of a button associated with a particular image operates to actuate a corresponding switch.

Figure 4:
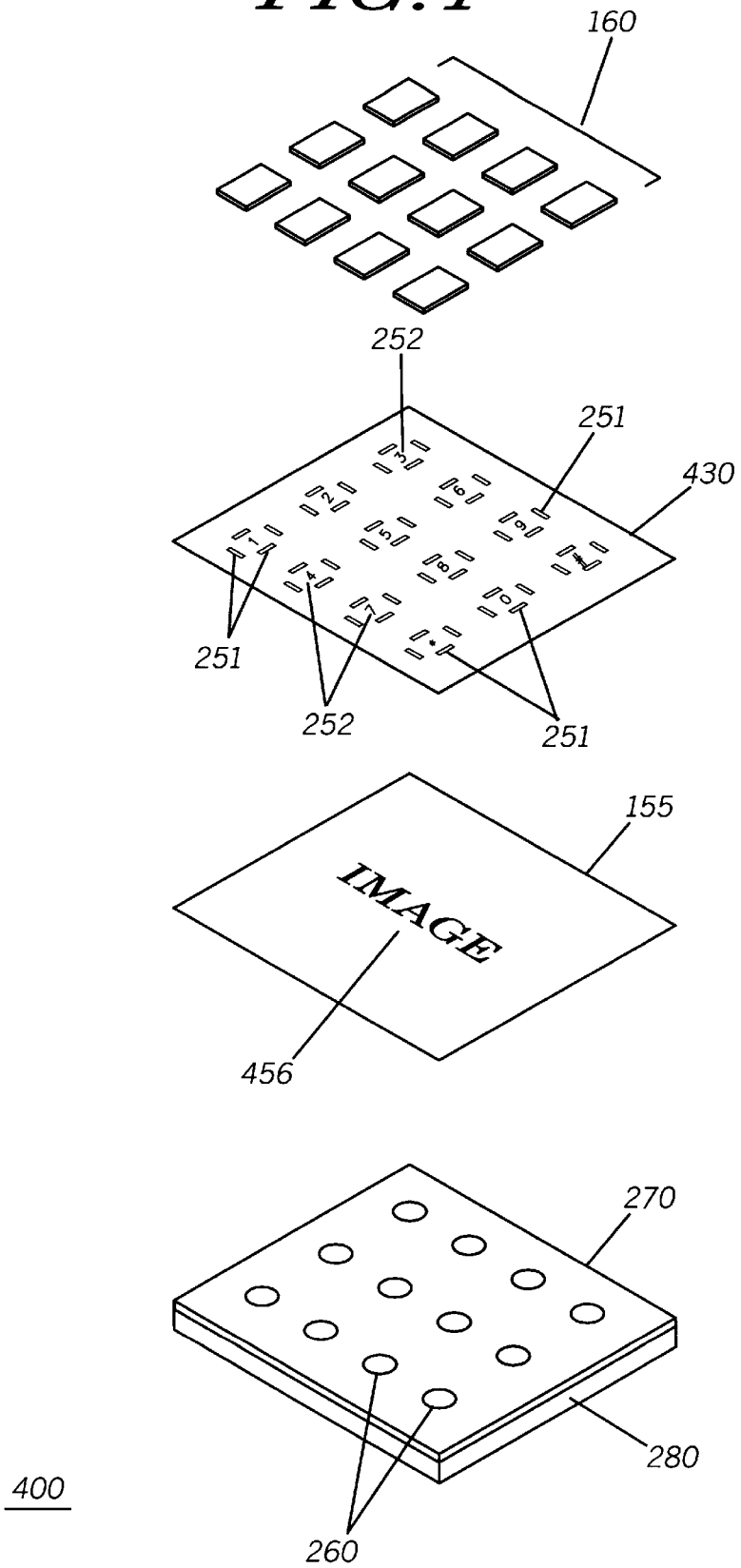
FIG. 4 is an exploded view of a second embodiment of the holographic keypad, in accordance with the present invention.

FIG. 4 shows a keypad interface 400, in accordance with the present invention. The keypad interface 400 differs from that described with respect to FIGS. 2 and 3, in that the buttons are embossed or formed on a light transmissive polyester film or other like plastic film 430, rather than directly on the holographic film 155. In this embodiment, button indicia is screen printed or pad printed on the light transmissive film 430. Further, the holographic film 155 has a general purpose image 456 and is positioned behind the key buttons 160 for background aesthetics, and to enhance ambient lighting and backlighting conditions for keypad use. Otherwise, the construction and functionality of the keypad interface 400 is similar to that previously described.

The present invention provides advantages over the prior art. By employing a holographic film as a backer for a keypad interface, significant aesthetics and functional benefits are provided. Lighting for keypad use is improved, both for ambient and backlit applications, including glare reduction and the like. Furthermore, decorative designs can enhance user appeal.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An electronic device having a keypad interface, comprising:

a holographic film having an image thereon;

a depressible switch actuator button formed from transparent material and embossed over the image on the holographic film; and a switch aligned with the actuator button and the image such that depression of the actuator button actuates the switch.

2. The electronic device of claim 1, wherein the image comprises button indicia indicating button functionality.

3. The electronic device of claim 1, further comprising a plurality of transparent buttons located over the holographic film, such that the holographic film provides a backing therefor.

4. The electronic device of claim 3, wherein the holographic material has cut out portions corresponding to individual buttons of the plurality of transparent buttons.

5. An electronic device having a keypad, comprising:

holographic material; and a plurality of switch actuator buttons molded onto the holographic material.

6. The electronic device of claim 5, wherein:

the plurality of switch actuator buttons are substantially transparent; and the holographic material is disposed below the plurality of switch actuator buttons and provide a reflector for ambient light transmitted through the plurality of switch actuator buttons.

7. The electronic device of claim 6, wherein the holographic material has images formed thereon, which images are positioned in register with individual buttons of the plurality of switch actuator buttons to indicate button functionality.

8. The electronic device of claim 7, wherein the holographic material has cut out portions around individual buttons.

9. A keypad, comprising:

a light transmissive film having first and second opposing surfaces;

an array of transparent buttons disposed over the first surface of the light transmissive film; and a holographic film disposed on the second surface of the light transmissive film, and providing a backing for the array of transparent buttons.

10. The keypad of claim 9, wherein the light transmissive film has button indicia formed thereon.

* * * * *